US005375523A

United States Patent [19]

Morris

[11] Patent Number: 5,375,523

[45] Date of Patent: Dec. 27, 1994

[54] PYROTECHNIC DEVICE

[75] Inventor: Nigel Morris, Louth, England

[73] Assignee: J.E.M. Smoke Machine Company, Ltd., Spilsby, England

[21] Appl. No.: 52,762

[22] Filed: Apr. 26, 1993

Related U.S. Application Data

[62] Division of Ser. No. 704,039, May 23, 1991, Pat. No. 5,313,887.

[30] Foreign Application Priority Data

May 23, 1990 [GB] United Kingdom ..... 9011559

[51] Int. Cl.[5] ..... F42C 19/00; H01R 11/00

[52] U.S. Cl. ..... 102/202.9; 439/440; 439/448

[58] Field of Search ..... 439/440, 448; 102/202.9

[56] References Cited

U.S. PATENT DOCUMENTS

| | | | |
|---|---|---|---|
| 174,771 | 3/1876 | Broadwell | 102/493 |
| 1,303,727 | 5/1919 | Rice | 29/1.21 X |
| 1,562,552 | 11/1925 | Hanley | 439/440 X |
| 2,724,736 | 11/1955 | Klumpp, Jr. | 439/448 X |
| 3,420,173 | 1/1969 | Slawinski | 102/24 |
| 3,474,389 | 10/1969 | Nagano | 439/440 |
| 3,491,694 | 1/1970 | Fountain | 102/67 |
| 3,580,173 | 5/1971 | Machet | 102/37.2 |
| 3,646,845 | 3/1972 | Semel | 86/20 A |
| 3,820,464 | 6/1974 | Dixon | 102/67 |
| 3,853,059 | 12/1974 | Moe | 102/67 |
| 4,173,384 | 11/1979 | Phillips | 339/101 |
| 4,327,643 | 5/1982 | Lasheras Barrios | 102/493 |
| 4,351,239 | 9/1982 | McCubbin | 102/364 |
| 4,365,560 | 12/1982 | Frostig | 102/477 |
| 4,433,625 | 2/1984 | Brown | 102/331 |
| 4,942,820 | 7/1990 | Sawruk | 102/482 |
| 5,040,464 | 8/1991 | Pearson | 102/493 |
| 5,095,821 | 3/1992 | Merz | 102/493 |

FOREIGN PATENT DOCUMENTS

| | | |
|---|---|---|
| 2022758 | 11/1968 | France . |
| 7502854 | 1/1975 | France . |
| 2327947 | 6/1973 | Germany . |
| 2025006 | 1/1980 | United Kingdom . |
| 1580579 | 3/1980 | United Kingdom . |

*Primary Examiner*—Peter A. Nelson
*Attorney, Agent, or Firm*—Jones & Askew

[57] ABSTRACT

A pyrotechnic device comprises a receptacle which contains a charge of pyrotechnic material and an electric fuse to initiate the charge. The receptacle is formed of a plastics housing which has an area formed of lines of weakness adapted to rupture on activation of the pyrotechnic material and a closure having an integrally moulded projection which defines a screw-thread, electric contacts being associated with the projection and trapping the bared ends of wires associated with the fuse.

7 Claims, 3 Drawing Sheets

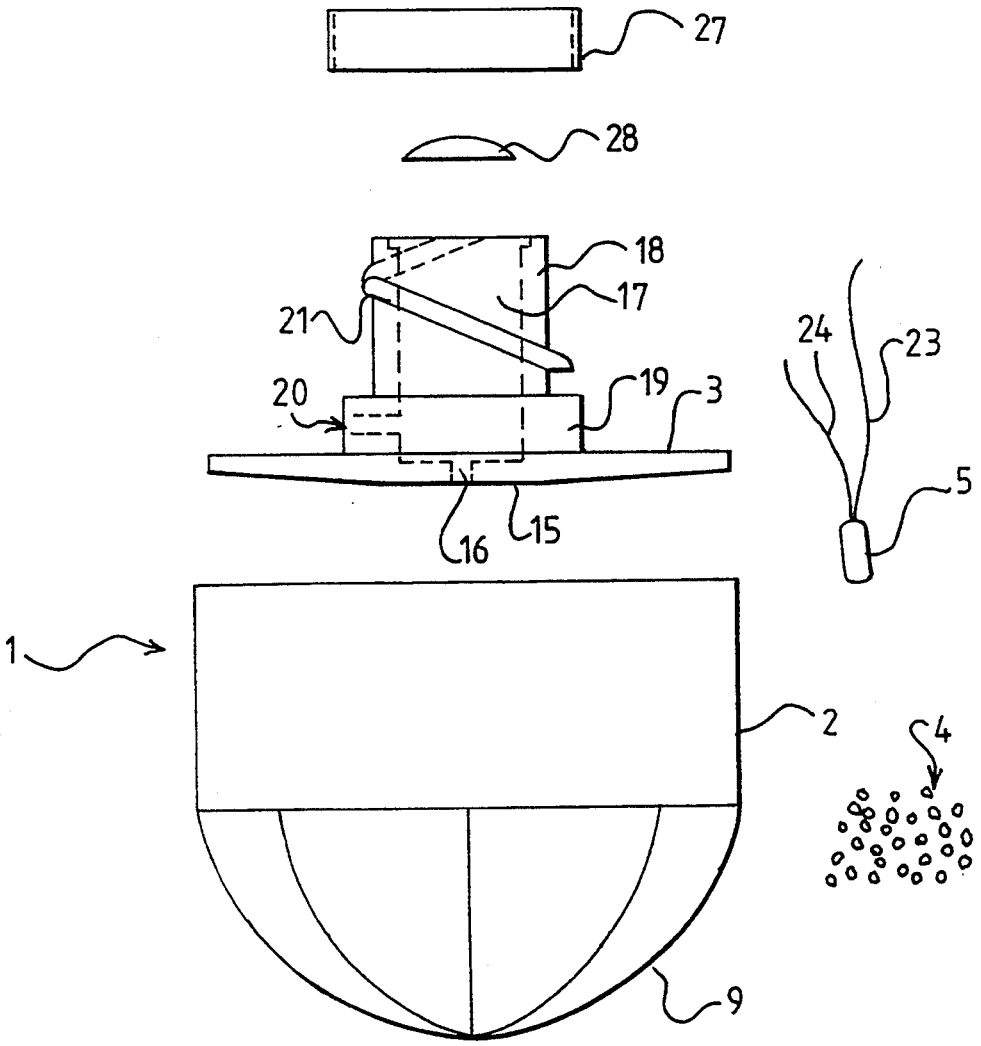
FIG 1
FIG 2
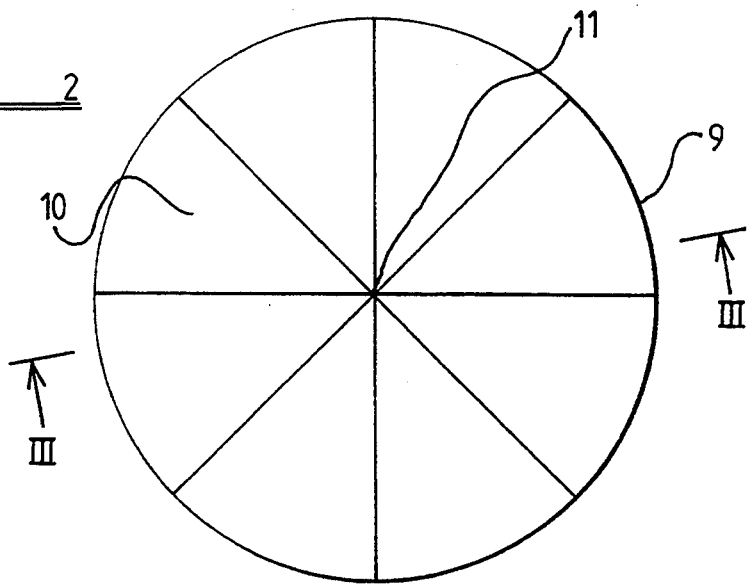

PYROTECHNIC DEVICE

This is a division of U.S. application Ser. No. 07/704,039, filed May 23, 1991, now U.S. Pat. No. 5,313,887.

BACKGROUND OF THE INVENTION

The present invention relates to a pyrotechnic device and more particularly relates to a pyrotechnic device intended to provide a theatrical effect.

It has been proposed before to provide pyrotechnic devices which give a theatrical effect. For example, reference may be made to British Patent 1580579 which discloses a pyrotechnic device which is in wide use at the present point in time to provide a flash or smoke burst effect. This device comprises a receptacle, moulded from plastics material, which is of hollow cylindrical form, having one closed end and one open end. Two pins pass through the closed end, and, on the interior of the receptacle, a fuse wire is connected between the exposed ends of the pins. The receptacle is partly filled with an appropriate pyrotechnic material, and is closed by a closure in the form of a sheet of paper adhered to the open mouth of the receptacle.

The described pyrotechnic device may be inserted in an appropriate socket in a firing box, the socket establishing electric contact with the two pins. An electric current may thus be caused to flow through the fuse wire, which initiates the device. The fuse wire ignites the pyrotechnic material, and the paper sheet is ruptured, since the paper sheet is formed of a material which is weaker than the rest of the receptacle.

Various difficulties exist with this prior device. Firstly, the paper closure is not very strong and is easily broken, especially when a plurality of the devices are packed in a single container, since the pins projecting from the base of one receptacle can easily puncture the paper closure on another receptacle. Furthermore, the adhesive that is used to secure the paper closure to the receptacle is fragile, and will break or snap if the device is dropped. This means that, in either case, pyrotechnic material may become dispersed, or become lodged in the packaging which represents a significant fire hazard.

The device often has to be inserted in the socket under relatively difficult conditions on stage. It is not unknown for stage-hands to panic and then inadvertently pus their fingers through the paper, thus releasing the pyrotechnic material. Also, it is difficult to locate the two pins in alignment with the corresponding pair of holes in the socket—this can lead to fumbling. If the pins catch the socket in an awkward way a spark can be developed, which is clearly undesirable where there is pyrotechnic material around.

Since the closure is only formed of paper, it is possible for moisture to enter the receptacle. This is clearly undesirable, since the presence of moisture may interfere with the operation of the pyrotechnic material. This can be particularly dangerous since when an electric current is passed through the fuse, the pyrotechnic material may not be ignited as intended. The device may, however, ignite as it is being removed from the firing box. This can be very dangerous.

It has been known for the paper covers to be removed from several such devices, and for the pyrotechnic material of all the devices to be combined in one of the receptacles, which, of course, does not have a cover.

This provides a very violent effect, and is very dangerous.

It has also been proposed to provide a further device, known as a maroon, which provides the effect of a loud explosion. Such a device has a charge of pyrotechnic material in a closed plastics material housing of uniform strength. A fuse or initiator in the housing is connected to a trailing lead or flex. In using such a device it has to be located in a special tank, called a "bomb tank", and the trailing lead or flex is connected to appropriate terminals. It is necessary to use the bomb tank since the device actually explodes, dispersing portions of the plastic material housing with considerable force.

OBJECT OF THE INVENTION

The present invention seeks to provide an improved pyrotechnic device.

More particularly the invention seeks to provide an improved pyrotechnic device in which the pyrotechnic material is maintained within a sealed receptacle, the receptacle being adapted that the receptacle ruptures, without producing any shrapnel, when the pyrotechnic material is ignited.

A further object of the present invention is to provide an improved pyrotechnic device which incorporates a screw-thread arrangement to enable the pyrotechnic device to be connected to a screw socket. The pyrotechnic device has a housing formed integrally of a plastics material, that housing also defining the screw-thread in order to minimize costs.

BRIEF SUMMARY OF THE INVENTION

According to one aspect of this invention there is provided a pyrotechnic device, said pyrotechnic device comprising a receptacle, the receptacle containing a charge of pyrotechnic material and means to initiate the charge, the receptacle being sealed, out having part thereof provided with lines or areas of relative mechanical weakness adapted to rupture on activation of the pyrotechnic material.

Preferably the lines or areas of mechanical weakness comprise a plurality of relatively thin webs formed in a wall of the receptacle.

Preferably the webs extend radially outwardly from a central point.

Conveniently the receptacle is formed of a housing defining an opening, and a closure connected to the housing to seal the opening, the housing and the closure being moulded of a plastics material.

Preferably the closure is connected to the housing by means of a screw-threaded engagement. However, the closure may additionally or alternatively be connected to the housing by welding, bonding or adhering.

Advantageously the means to initiate the charge by pyrotechnic material comprise a fuse adapted to initiate the charge when an electric current is passed through the fuse.

Preferably the receptacle is provided with a projecting portion carrying a screw-thread for engagement with a corresponding socket, the projecting portion carrying two separate electric contacts which are electrically connected to the fuse, such that when the threaded projecting portion is screwed into an appropriate corresponding socket, an electric current can be passed from the socket through the fuse, to initiate the device.

Conveniently the projecting portion is provided on the closure.

Preferably the projecting portion is integrally moulded of plastics material and defines a screw-thread thereon, the projecting portion being provided with two separate metallic contacts which are in electrical contact with the fuse.

According to another aspect of this invention there is provided a pyrotechnic device comprising a two-part receptacle, the two parts each being moulded of a plastics material and being secured together to hermetically seal the receptacle, the receptacle containing pyrotechnic material and a fuse to ignite the pyrotechnic material, there being an integrally moulded projecting portion on one of the parts, the portion defining a screw-thread thereon, and being provided with two separate metallic contacts which are in electrical contact with the fuse.

Conveniently one electrical contact comprises a ring-shaped contact surrounding the base of the projecting portion and engaging a wire connected to the fuse, and the second contact comprises an element received in a recess at the end of the projecting portion and again in contact with a wire leading to the fuse.

Preferably the contact elements each serve to trap part of the respective wire between the contact element and part of the said projection.

According to another aspect of this invention there is provided a pyrotechnic device comprising a two-part receptacle formed of plastics material, the two parts being secured together to hermetically seal the receptacle, the receptacle containing pyrotechnic material and a fuse to ignite the pyrotechnic material, the fuse being electrically connected to two contacts forming part of a projecting screw-threaded arrangement on the exterior of the receptacle, part of the receptacle being provided with one or more lines or areas of relative mechanical weakness adapted to rupture when the fuse is operated to activate the pyrotechnic material.

The invention also relates to a method comprising a pyrotechnic device, the method comprising the steps of moulding two plastics material components which can be assembled together to form a closed receptacle, at least one of the components being provided with one or more lines of mechanical weakness which can rupture under applied pressure, providing one of the components with a fuse and electrical contact means electrically connected to the fuse, the contact means being adapted to be on the exterior of the receptacle, introducing a charge of pyrotechnic material into the receptacle and assembling the two components of the receptacle together to form a sealed receptacle containing the fuse and the pyrotechnic material.

Preferably the two components comprise a housing and a closure, the housing and the closure each defining co-operating screw-threads, the method comprising the step of screwing the closure to the housing.

The invention further relates to a method of making a pyrotechnic device, said method comprising the steps of moulding a housing of elongate form, having a side wall, the housing being opened at one end and being closed at the other end, the closed end of the housing having a plurality of lines of relative mechanical weakness; moulding a closure for the housing from a plastics material; providing the closure with a fuse and with electrical contact means, positioned to be on the exterior of the receptacle, in electric contact with the fuse; introducing a charge of pyrotechnic material into the receptacle; and securing the closure to the housing, to seal the housing, with the fuse on the interior of the housing.

Preferably the method comprises the steps of baring portions of contact wires extending from the fuse, locating the bared ends of the wires in predetermined positions on a threaded projection, and mounting contact means on the boss to engage the said wires.

According to another aspect of this invention there is provided an electrical contact arrangement comprising an elongate element moulded or formed of an electrically insulating material having a screw thread formed thereon, the element being provided with two separate metallic contacts at spaced locations, exposed to the exterior of the element, and contacting leads extending to or through the interior of the element.

Preferably one contact comprises a substantially ring shaped contact surrounding part of the elongate element, and the second contact comprises an element received in a recess at one end of the element.

Conveniently each contact traps a said lead between the contact and part of said element.

According to a further aspect of this invention there is provided a socket adapted to receive an electric contact arrangement which has a screw-thread formed thereon, the socket comprising a housing moulded of plastics material having a hollow projecting boss, the hollow boss defining, on its interior, means to engage the screw-thread formed on said arrangement, two contact elements being provided in said hollow boss engage two separate metallic contacts, at spaced locations, on said arrangement.

Preferably one of the contact elements comprises a ring of hard metal located adjacent, and surrounding, an open end of the interior of the boss.

Conveniently the other of the contact elements comprises a spring biassed contact located at the base of the hollow interior of the boss of the socket.

The invention also relates to a combination of a contact assembly and a socket as described above.

INTRODUCTION TO THE DRAWINGS

In order that the invention may be more readily understood, and so that further features thereof may be appreciated, one example of the invention will now be described, by way of example, with reference to the accompanying drawings in which FIG. 1 is a side exploded view of a pyrotechnic device in accordance with the invention with parts shown in phantom, FIG. 2 is a top view of the device of FIG. 1, FIG. 3 is an enlarged sectional view of the arrangement shown in FIG. 1, partly assembled and partly exploded, taken on a line indicated by III—III of FIG. 2, and FIG. 4 is a sectional exploded view of a socket to receive the device of FIGS. 1 to 3.

DESCRIPTION OF PREFERRED EMBODIMENTS

Figure 3:
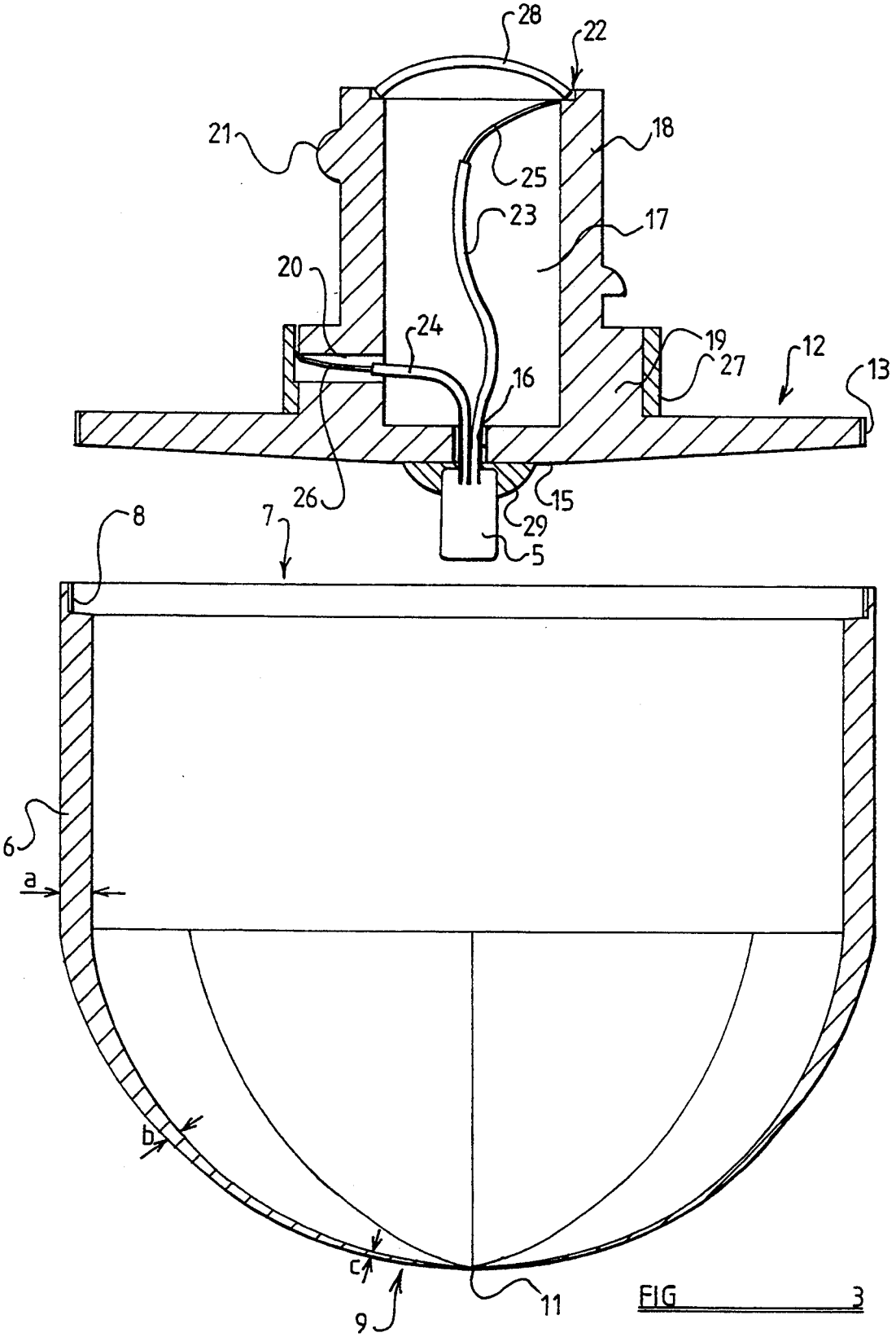
Figure 4:
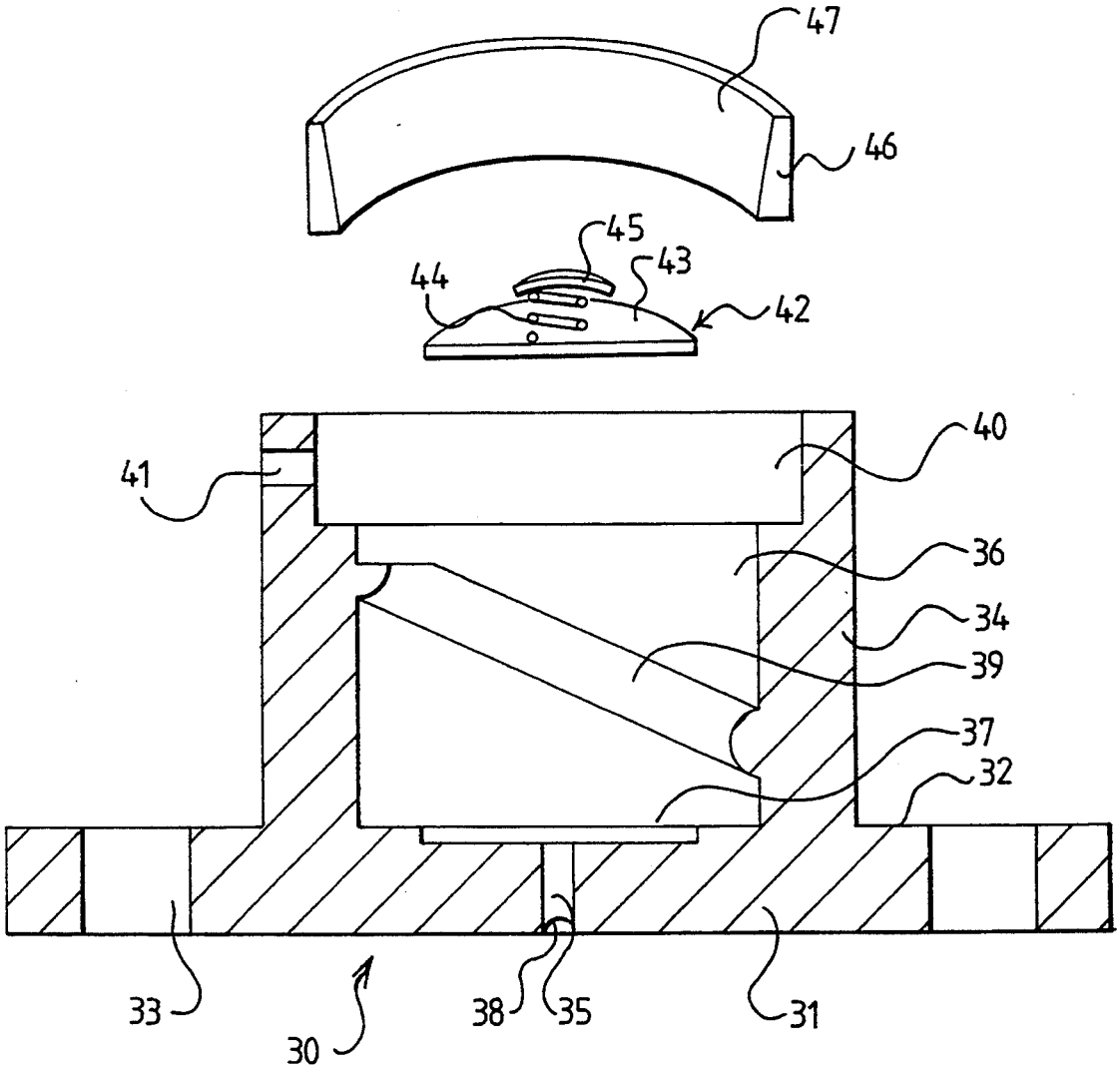

Referring to the drawings, a pyrotechnic device in accordance with the invention consists of a receptacle 1 formed from a hollow housing 2 and a closure 3 for the housing 2. Both the housing 2 and the closure 3 are moulded from an appropriate plastics material, which is preferably flame retardant. The receptacle 1 is adapted to contain a charge of pyrotechnic material schematically illustrated at 4, and a fuse 5 to ignite the pyrotechnical material.

The housing 2, as can be seen in FIGS. 1, 2 and 3, consists of an integral moulding of the plastics material and has a tubular portion 6 comprising a cylindrical wall defining one open end 7. The open end 7 is provided with an internal recess in which is provided a circumferated screw thread 8. The other end of the tubular portion 6 extends to form a transverse wall in the form of a dome 9 which effectively closes that end of the tube. The material forming the dome 9 is thinner than the material forming the portion 6, and the thickness of the material reduces towards the apex of the dome. Thus, the wall thickness of the tubular portion 6, as indicated at the point a is 1.78 millimeters, whereas the wall forming part of the dome as indicated at the point b is 0.51 millimeters thick and at the point c, towards the apex of the dome is 0.13 millimeters thick. The dome 9 is provided with eight channels 10 formed therein which each extend linearly from the apex of the dome 11, to the end of the tubular portion 6, the channels 10 being equi-angularly spaced. The channels can be considered to extend radially outwardly from a single point at the apex of the dome. Each channel has a width of 0.13 millimeters and the material thickness defining the base of the channel is 0.13 millimeters. The channels are formed on one exterior of the dome but may, in an alternative embodiment of the invention, be formed on the interior of the dome 9. The thin region at the apex of the core and channels form lines of relative mechanical weakness, with regard to the thicker, and thus stronger, material forming the rest of the dome, for a purpose that will be explained more fully hereinafter.

The closure 3 for the housing 2 comprises a disc 12 which has, at its outer periphery, a screw-thread 13 adapted to co-operate with the screw-thread 8 provided at the open end 7 of the tubular portion 6 of the housing 2. The lower surface of the disc (in the orientation shown) has a central planar circular region 15, and the disc then tapers radially outwardly to the periphery thereof. The thickness of the disk 12 at the periphery thereof is equal to the thickness of the wall of the tubular portion 6. At the center of the disc an aperture 16 is provided leading to the hollow interior 17 of a boss 18 that extends upwardly from the top of the disc, in the orientation shown in the drawings. The lower part of the boss 18, adjacent the disc 12, is enlarged to form a shoulder 19. A radially extending bore 20 is provided extending from the hollow interior 17 of the boss 18 to the exterior of the shoulder 19.

Formed on the exterior of the boss 18 are three helical ribs 21 of semi-circular form which form a three-start screw-thread. Only one rib is illustrated in the drawings for the sake of clarity of illustration.

At the free end of the boss 18 a recess 22 is provided which forms a terminal enlargement of the hollow interior 17 of the boss 18.

The fuse 5 is an electric fuse which has two insulated wires 23,24 extending therefrom. These wires would be cut to an appropriate length and the ends of the wires would be bared 25,26. The fuse 5 contains a wire or element which becomes hot when an electric current passes through it, surrounded by an ignition pill or the like, so that when a current passes through the fuse, the fuse ignites.

An annular contact ring 27 of metal, such as brass or the like, is provided dimensioned to be a friction fit on the shoulder 19, and a dish-shaped metallic contact disc 28, again of brass or the like, is provided adapted to be a snap-fit within the recess 22 provided at the end of the boss 18.

In assembling the pyrotechnic device in accordance with the invention, initially the two wires 23,24 of the fuse 5 are cut to an appropriate length and have the end portions thereof bared 25,26. The wires 23,24 are then passed upwardly through the central aperture 16 formed in the disc 12 of the closure 3. The wire 24 is threaded through the bore 20 so that the bare end 26 of the wire emerges from the end of the bore 20. The other wire 23 has the bare portion thereof located to pass over the recess 22. The contact ring 27 may then be slid into position on the collar 19 trapping the bare end of the wire 26 between the ring 27 and the collar 19, thus establishing contact between the wire 24 and the ring 27. Similarly, the dish-shaped contact element 28 may be snapped into position trapping the bare part of the wire 25 between the edge of the dish-shaped element 28 and the recess 22. Thus again, electrical contact is established between the wire 23 and the dish-shaped element 28. The fuse 5 may be held in position against the convex under surface 15 of the disc 12 by means of a hot-melt 29 although a quick setting adhesive could be used. The hot melt or the adhesive seals the aperture 16.

The charge of pyrotechnic material 4 is then inserted into the housing 2, and the closure 3 is screwed into position on the housing 2. The closure 3 is screwed tight so that the receptacle 1 is sealed. The joint between the closure and the housing may additionally be sealed with adhesive, or with a welding step, or be bonded in some other way—for example, ultrasonic bonding. This prevents the contents of several devices being amalgamated to provide an enhanced effect.

Since the receptacle 1 is totally sealed, and since the receptacle is made of a material that is impermeable to water and water vapour, there is no way that moisture can gain access to the pyrotechnic material 4 within the receptacle 1. Also, since the receptacle 1 is fabricated from a plastics material, and since the receptacle does not have protruding pins, the risk of the receptacle being punctured or otherwise broken in an inadvertent manner, either while packed, or while being inserted into a socket is significantly reduced.

When a pyrotechnic device as described with reference to FIGS. 1 to 3 is to be utilized, the housing will be inverted, so that the projecting boss 18 is located on the under-side of the arrangement. The closure 3 thus forms the lower wall of the closed receptacle, and the dome 9 forms the upper wall. The boss 18 may then be inserted into an appropriate screw-threaded socket 30 (which is similar to an "Edison" socket) and by rotating the housing the boss 18 will be screwed into the socket. Because the device is screwed in, it is easier to locate in the socket in the dare or under difficult conditions on stage, and there is less chance of a spark being generated.

The socket 30 comprises a first element 31 integrally moulded of a plastics material and presenting a substantially planar base 32 provided with apertures 33 in a peripheral portion thereof to enable the base to be secured to an underlying support by means of screws or bolts. Provided in the center of the base 32 is an upstanding tubular boss 34 which is substantially hollow, with an open top. A bore 35 extends through the base into the hollow interior 36 of the boss 34, and terminates in a large open topped recess 37 formed in the base 32. A arcuate section channel 38 extends across the underside of the base 32 from the bottom of the bore 35 to the periphery of the base 32 for a purpose that will be explained hereinafter.

Formed on the interior wall of the tubular boss 34 is a screw-threading arrangement 39 dimensioned and designed to co-operate with the helical ribs 21 forming the screw-thread described above. The arrangement 39 comprises ribs formed on the interior wall of the boss, but in an alternative embodiment may comprise helical grooves to receive the ribs 21.

The upper part of the hollow interior 36 of the boss 34 comprises a radially enlarged recess 40 which is associated with a radially extending bore 41 which extends through the wall of the boss 34.

A first contact element 42 is provided in the form of a plate 43 adapted to be received within the recess 37 as a friction fit, the plate 43, carrying on its upper surface a centrally located compression spring 44 which extends upwardly and supports a contact disc 45 formed of an appropriate metal. Soldered to the bottom of the plate 43 is the bare end of a wire which is passed upwardly through the bore 35, the wire being accommodated in the recess 38 when the base 32 is secured to an underlying support.

A second contact element in the form of a contact ring 46 is provided, adapted to fit as a friction fit within the recess 40. A wire may have a bare end thereof passed through the bore 41, the bare end being soldered to the contact ring 46 when the contact ring 46 is inserted into the recess 40. The contact ring 46 presents a tapering inner face 47. The contact ring 46 is formed of a hard metal, such as hardened steel.

When the boss 18 of the pyrotechnic device is inserted into the socket 30, as described, from above, the boss 18 is inserted into the hollow interior 36 of the boss 34. On rotation of the housing 2 in an appropriate sense the ribs 21 engage and co-operate with the ribs 39, drawing the boss 18 into the hollow interior 36 of the boss 34. The dish-shaped element 28 engages the contact disc 45 and moves the contact disc 45 downwardly against the bias of the spring 44. At that stage the exposed corner of the contact ring 27 engages the tapering face 47 of the contact ring 46. The device is thus secured in the socket and electrical contact is established between the wires associated with the socket and the two contact elements provided on the pyrotechnic device.

The socket is thus adapted to establish electric contact with the ring 27 and the disk-shaped element 28, to enable an electric circuit to be completed to enable a current to be passed through the fuse 5. Because the receptacle had been inverted the pyrotechnic material will be in contact with the fuse, and will thus be ignited when the fuse ignites.

When the pyrotechnic material is ignited the pressure within the receptacle 1 rises, and the receptacle bursts, initially along the area and lines of relative mechanical weakness constituted by the thin area at the apex of the dome and by the material forming the channels 10. Typically, the dome then opens, like the petals of a flower, and the device provides the desired pyrotechnic effect.

Since the areas or lines of relative mechanical weakness rupture, the receptacle can open with no parts or fragments becoming separated from the main part of the receptacle. The described pattern of lines of relative mechanical weakness which extend radially outwardly from a point provides substantially triangular areas of strong material which lie between the weak lines, and these "triangles" are deflected by the pressure within the receptacle to "open" the receptacle.

The effect provided by the device depends upon the precise nature of the pyrotechnic material introduced into the receptacle 1. Thus the device may be a flash or a smoke effect or any other desired effect.

Whilst the invention has been described with reference to one embodiment, it is to be appreciated that many modifications may be effected without departing from the scope of the invention. For example, while the closure 3 is connected to the housing 2 by means of a screw-threaded arrangement, the closure 3 may be connected to the housing 2 in some other way, for example by means of an adhesive or by means of sonic welding, or by means of a hot melt. The configuration of the lines of weakness provided on the receptacle may take many forms and indeed, instead of lines of weakness as constituted by the channels, a relatively large area of mechanical weakness may be defined by a thin web. It is, however, preferred to use lines of mechanical weakness since this can provide the desired "burstablity" when the device is ignited, whilst still giving a strong receptacle that will not easily be punctured or damaged during transit.

Whilst the area of the receptacle provided with the lines of mechanical weakness is shown as being of a dome configuration, this is not essential and this part of the receptacle may take any desired form.

I claim:

1. An electrical contact arrangement comprising an elongate element formed of an electrically insulating material having a screw thread formed on the exterior thereof, adjacent one end of the element, the element being provided with two separate metallic contacts at spaced locations, and exposed to the exterior of the element, and contacting leads extending to the metallic contacts through the interior of the element, one said contact being at a location spaced from an end of the element and the other said contact being located at said one end of the element, the screw thread being located between the two contacts.

2. An arrangement according to claim 1, wherein said cone contact comprises a substantially ring-shaped contact surrounding part of the elongate element, and the other said contact comprises an element received in a recess at said one end of the element.

3. An arrangement according to claim 2 wherein each contact traps a said lead between the contact and part of said element.

4. An arrangement according to claim 1 wherein one electrical contact comprises a ring-shaped contact surrounding a base portion of the elongate element and engaging a wire connected to a fuse, and the second contact comprises an element received in a recess at the end of the elongate element and again in contact with a wire leading to the fuse.

5. A device according to claim 4 wherein the contact elements each serve to trap part of the respective wire between the contact of the elongate element.

6. An electrical contact arrangement according to claim 1, wherein the contacting leads extend to the interior of a two-part receptacle, the two parts each being molded of plastics material and being secured together to hermetically seal the receptacle, the receptacle containing pyrotechnic material and a fuse to ignite the pyrotechnic material, the said leads extending to and being in electrical contact with the fuse.

7. A device according to claim 6 wherein the contact elements each are operative to trap part of the respective wire between the contact element and part of the elongate element.

* * * * *